US005683858A

United States Patent [19]

Fyson

[11] Patent Number: 5,683,858

[45] Date of Patent: Nov. 4, 1997

[54] PHOTOGRAPHIC BLEACH COMPOSITION

[75] Inventor: John Richard Fyson, London, England

[73] Assignee: Eastman Kodak Company, Rochester, N.Y.

[21] Appl. No.: 665,991

[22] Filed: Jun. 19, 1996

Related U.S. Application Data

[63] Continuation of Ser. No. 379,034, Jan. 27, 1995, abandoned, which is a continuation of Ser. No. 94,183, filed as PCT/EP92/02762, Nov. 30, 1992.

[51] Int. Cl.[6] ..... G03C 7/00; G03C 5/44; G03C 5/18; G03C 5/26

[52] U.S. Cl. ..... 430/393; 430/430; 430/461; 430/491; 430/490; 430/936; 430/943

[58] Field of Search ..... 430/393, 418, 430/428, 429, 430, 455, 460, 461, 490, 491, 936, 943

[56] References Cited

U.S. PATENT DOCUMENTS

| | | | |
|---|---|---|---|
| 4,203,765 | 5/1980 | Claeys et al. | 430/418 |
| 4,277,556 | 7/1981 | Koboshi et al. | 430/393 |
| 4,328,306 | 5/1982 | Idota et al. | 430/393 |
| 4,454,224 | 6/1984 | Brien et al. | 430/393 |
| 4,737,450 | 4/1988 | Hall et al. | 430/393 |
| 4,933,266 | 6/1990 | Stephen et al. | 430/393 |
| 4,939,073 | 7/1990 | Koboshi et al. | 430/393 |
| 5,270,148 | 12/1993 | Morigaki et al. | 430/430 |

FOREIGN PATENT DOCUMENTS

| | | | |
|---|---|---|---|
| 54-1026 | 1/1979 | Japan | 430/393 |
| 56-121035 | 9/1981 | Japan | 430/461 |

OTHER PUBLICATIONS

Patent Abstracts of Japan, vol. 12, No. 25, P-659, Processing Method for Silver Halide Color Photosensitive Material, 62-178263.

*Primary Examiner*—Glenn A. Caldarola
*Assistant Examiner*—J. Pasterczyk
*Attorney, Agent, or Firm*—Sarah Meeks Roberts; J. Lanny Tucker

[57] ABSTRACT

A photographic bleach solution contains hydrogen peroxide, or a compound capable of releasing hydrogen peroxide, and two or more sequestering agents capable of complexing with a transition metal. The bleach solution ha a pH in the alkaline range. A method of using such a photographic bleach solution is also disclosed.

16 Claims, 2 Drawing Sheets

PHOTOGRAPHIC BLEACH COMPOSITION

This application is a continuation of application Ser. No. 08/379,034, filed on Jan. 27, 1995, now abandoned, which is a file wrapper continuation of Ser. No. 08/094,183, filed as PCT/EP92/02762, Nov. 30, 1992, now abandoned.

FIELD OF THE INVENTION

This invention relates to photographic bleach compositions for use in photographic colour processing.

BACKGROUND OF THE INVENTION

There are a number of proposals in the art to use peroxy compounds, e.g. hydrogen peroxide or a compound capable of releasing hydrogen peroxide, in bleach compositions in conventional colour processes. Some peroxide bleach solutions must contain an organic metal complex salt e.g. U.S. Pat. No. 4,301,236, while others must employ a bleach accelerator e.g. Japanese specifications 611250647A and 611261739A.

In U.S. Pat. No. 4,277,556 there are described bleach solutions having a pH between 2.0 and 5.5 consisting of a hydrogen peroxide solution and a mono- or dicarboxyllc acid, or an alkylidene diphosphonic acid, typically 50 ml/l 30% of hydrogen peroxide solution and 30 ml/l concentrated acetic acid. Such solutions however do not bleach the entire amount of silver present. U.S. Pat. No. 4,454,224 describes an improvement on this in which the hydrogen peroxide bleach solution is alkaline having a pH of 7 or more and contains a polyacetic acid such as diethylenetriaminepentaacetic acid or 'DTPA'. This complexes with the silver ion formed by the oxidising action of the peroxy compound and the silver complex thus formed, being soluble in the photofixing composition, can then be readily removed. In spite of all these suggestions no such solution has ever been used commercially. There is further disclosed in European Patent Application Publication No. 0 428 101 A1 an alkaline bleach solution containing a water-soluble chloride for producing rapid desilvering to which an organic phosphonic acid may be added to eliminate blister formation.

It has also been established that peroxide bleaches used for processes for low silver materials are unstable and decompose in a matter of days or even hours, becoming unusable. Complex metal ions, which are naturally present in the water used to make up the bleach or which leach out of the paper during processing, catalyse the decomposition of the peroxide in the bleach. In U.S. Pat. No. 4,454,224 it can be seen that 'DTPA' has little or no stabilising effect on the bleaching agent at the pH used.

SUMMARY OF THE INVENTION

It has now been found, however, that the addition of even a tiny amount of a combination of two or more sequestering agents which can complex with a transition metal ion, can significantly enhance the stability of peroxide bleaches at a particular pH range. This preservation of the active ingredient of the bleach causes a reduction in waste and is inexpensive compared to replacement of the solution.

According to the present invention therefore there is provided a photographic bleach solution, comprising hydrogen peroxide, or a compound capable of releasing hydrogen peroxide, and in combination two or more sequestering agents for complexing with a transition metal which will inhibit the decomposition of the bleach. The preferred pH range is from 5.5 to 14.

DETAILED DESCRIPTION OF THE INVENTION

Figure 1:
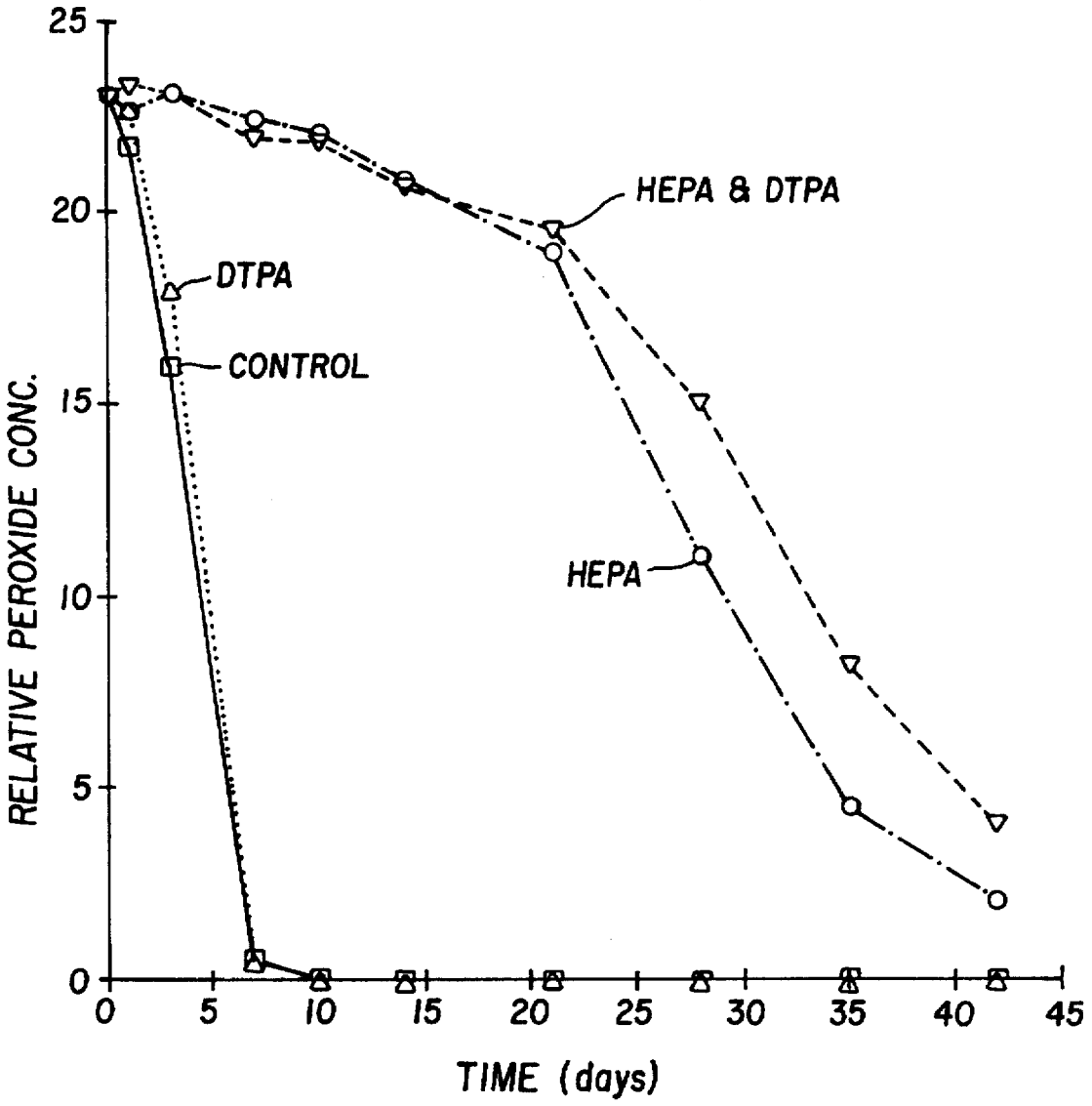
FIG. 1 is a graph of relative peroxide concentration versus time (days) showing the effect of HEPA and DTPA on peroxide stability at a pH of 8.0.

Sequestering agents which may be suitable include two or more of the following:

- a polyalkylcarboxylic, phosphonic or sulphonic acid containing at least one amine group which has condensed with one or more alkyl hydrogens of the alkylcarboxylic, phosphonic or sulphonic acid, such as a compound of formula (I) as defined hereinbelow or a salt thereof;
- an alkylidene-1,1-diphosphonic acid, such as a compound of formula (II) as defined hereinbelow; a polyhydroxyphenyl such as a compound of formula (III) as defined hereinbelow; or
- a polyphosphate such as a compound of formula (IV), as defined hereinbelow, or an alkali metal salt thereof.

If a single sequestering agent is used some stabilising effect occurs but this is surprisingly dependent upon the pH used. Thus although a compound of formula (I), such as 'DTPA', has negligible effect at an alkaline pH, as mentioned hereinbefore, at a mildly acidic pH, for example pH 6.0, it can be highly effective in stabilising bleach.

A compound of formula (I) is represented by the structure.

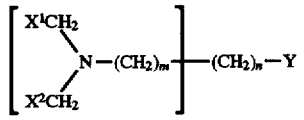

(I)

A wherein $X^1$ and $X^2$ may be the same or different and each is a hydrogen atom, a straight or branched chain alkyl group having 1 to 6 carbon atoms, a hydroxyl, carboxyl, sulphonyl or phosphonyl group or the group Z, wherein Z=

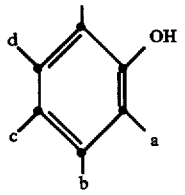

wherein a, b, c and d are the same or different and each is a hydrogen atom, a straight or branched chain alkyl group having 1 to 6 carbon atoms, a hydroxyl, carboxyl, sulphonyl or phosphonyl group or either $X^1$ and/or $X^2$ may be repeat units of A or B, Y is as defined for a, b, c and d or is the group Z or the group B,

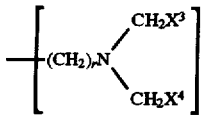

B wherein $X^3$ and $X^4$ are the same or different and are as defined for $X^1$ and $X^2$ wherein the sum of m, n and r is an integer from 1 to 10 and wherein one or both of the hydrogen atoms in each of the $(CH_2)_m$,$(CH_2)_n$ or $(CH_2)_r$ groups may be replaced by a straight or branched chain alkyl group having 1 to 6 carbon atoms, with the proviso that at least one of $X^1$, $X^2$, $X^3$ and $X^4$ is or contains a carboxylic, sulphonyl or phosphonyl group, or a salt thereof.

Examples of compounds of formula (I) that are particularly suitable are ethylenediaminetetraacetic acid 'EDTA' propylenediaminetetraacetic acid 'PDTA', nitrilotriacetic acid 'NTA' but most preferably diethylenetriaminepentaacetic acid 'DTPA', these compounds generally being used in the form of their corresponding tetra- or penta-sodium salts.

In contrast, an alkylidene -1, 1-diphosphonic acid of formula (II)

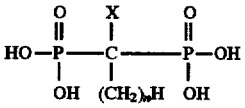

(II)

wherein X is a hydrogen atom, a halogen atom or a hydroxyl group and n is from 0–12 whilst found to be suitable over a range of pH from 5.5 to pH 14 is more effective in the alkaline range. For example at pH 8.0 the preferred compound 1-hydroxy-ethylidene-1,1-diphosphonic acid (X=OH, n=1) or 'HEPA' has been found to have surprising stabilising effect in preserving the peroxy compound.

Compounds of formula (III) and (IV) are both more effective in stabilising bleach at a mildly acidic pH, these compounds having the formulae represented hereinunder:

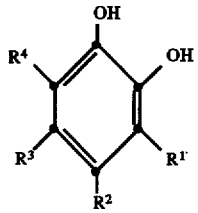

(III)

wherein $R^1$, $R^2$, $R^3$ and $R^4$ are the same or different and each is a hydrogen atom, a straight or branched chain alkyl group having 1 to 6 carbon atoms, a hydroxyl, sulphonyl or carboxyl group, especially dihydroxyphenyl sulphonate ('catechol' disulphonate 'CDS') or 'TIRON'™ and $$HO(P(O)(OH)O—)_nH \quad (IV)$$

wherein n is from 4 to 12, preferably 4 to 8 or an alkali metal salt thereof, such as 'QUADRAFOS'™ or 'CALGON'™.

However, according to the invention and for optimum bleaching efficiency a combination of two or more sequestering agents is used. Thus, although 'DTPA' has little effect at an alkaline pH, its combination with the effective 'HEPA' produces a further enhanced or 'synergistic' effect.

A synergistic effect may be said to occur when at some time during the storage of the bleach solution the combined stabilising effect of two or more of the components is greater than the sum of the individual stabilising effects of the two or more components.

In a preferred aspect of this invention such an effect may result by the combination of a polyalkylcarboxylic acid of formula (I) or a salt thereof with a diphosphonic acid of formula (II) or a polyphosphate of formula (IV) or an alkali metal salt thereof.

In a most preferred aspect of this invention the combination comprises diethylenetriamine-pentaacetic acid, 'DTPA' or a salt thereof and 1-hydroxy-ethylidene-1,1-diphosphonic acid, 'HEPA'.

The components may be combined with the ratio of any two components being in the range 1:1 to 1:10 by volume wherein either component may be present in the greater amount.

Each sequestering agent as a component in the synergistic combination, is added in an amount of from 0.005 to 5% by weight of bleach solution, preferably from 0.04 to 0.1% by weight.

Compounds capable of releasing hydrogen peroxide include metal peroxides; compounds which include hydrogen peroxide in their crystal structure such as sodium percarbonate; other peroxy compounds such as sodium perborate and persulphate; or soluble organic peroxides, such as butyl peroxide or benzyl peroxide.

The hydrogen peroxide or a compound such as mentioned above is added in a sufficient quantity to enable the bleach step to take place in a suitable length of time. Conveniently commercially available 30% hydrogen peroxide is used in an amount of from 20 to 100 ml/liter bleach solution, preferably about 50 ml/liter, but equivalent amounts of, for example, 8% or 3% hydrogen peroxide may also be used.

The bleach solution preferably has one or more acids, alkalis or buffers to maintain the pH at the required level, such as an alkali metal carbonate, carbonate/hydrogen carbonate buffer, phosphate buffer, amine/borate buffer, boric acid, or a carboxylic acid, such as acetic acid, propionic acid or glycollic acid.

The bleach solutions of the present invention may be used with any type of photographic silver halide colour material. Such materials and their possible constituents are described, for example, in Research Disclosure Item 308119, December 1989, published by Kenneth Mason Publications, Emsworth, Hants., United Kingdom. However materials based on predominantly silver chloride emulsions are preferred.

The present invention also provides a method of photographic colour processing including a bleach step, which comprises the addition of hydrogen peroxide, or a compound capable of releasing hydrogen peroxide, and in combination two or more sequestering agents for complexing with a transition metal which will inhibit catalytic decomposition of the bleach.

The bleach step may directly follow the developing or redox amplification stages or an intermediate stop bath may be employed.

The photographic material to be processed preferably contains low levels of silver and is preferably based on emulsions which comprise at least 80%, preferably at least 90%, silver chloride and especially substantially pure silver chloride.

The invention will now be described with reference to the following examples which in no way limit the scope of the invention.

EXAMPLE 1

A peroxide bleach, suitable for use with a low silver paper material, was made up with the following formula:

| | |
|---|---|
| hydrogen peroxide 30% | 50 ml |
| sodium hydrogen carbonate | 25 g |
| potassium chloride | 0.5 g |
| tap water to | 1 liter |

To this solution was added 1 ml of water containing 0.1% by weight of each of the transition metals copper (II), iron (III) and manganese (II) as their sulphates, giving a final concentration of each of these metal ions of 1 ppm.

To a 100 ml sample of this bleach, 0.1 ml of 1-hydroxyethylidene-1,1-diphosphonic acid ('HEPA') was added. To another 100 ml sample 0.1 ml 80% diethylenetriaminepentaacetic acid ('DTPA') was added and to yet another 100 ml sample 0.1 ml of each of 'HEPA' and 'DTPA' was added. A control sample of 100 ml with no sequestering agent was also taken. The pH of each sample was adjusted to 8.0 with sodium hydroxide solution or dilute sulphuric acid as appropriate and the solutions transferred into clean brown glass bottles, which were kept in the dark at room temperature (about 20° C.).

At intervals the amount of residual hydrogen peroxide was determined using the method outlined on page 363 of the 3rd edition of 'A Text-book of Quantitative Inorganic Analysis' by Vogel. The titration was made with 5 g/l sodium thiosulphate. The residual peroxide was determined as the amount of this solution need to reach the end point.

The results, which are shown graphically in FIG. 1, show that 'HEPA' preserves the hydrogen peroxide to a substantial extent and an even greater improvement results by the addition of 'DTPA', indicating a synergistic effect between the sequestering agents, even though 'DTPA' on its own has little or no effect.

Thus, whereas the relative peroxide concentration of the control sample and 'DTPA' falls to zero within 10 days, with both 'HEPA' and the combination of 'HEPA' and 'DTPA' very little peroxide is destabilised until three weeks have elapsed and there is still a residual effect after six weeks.

In order to try the bleaching ability of the stored bleach it was tested as follows:

A piece of conventional silver-chloride-based photographic color paper (containing a total silver coverage of 700 mg/m$^2$) was exposed to room light for 10 seconds, developed for 45 seconds in a conventional color developer and plunged into the bleach solution. The silver loss was followed by observing the transmitted infra-red density. The time of bleaching was taken as the time taken to reach a point at which the density no longer changed. The time for bleaching increased by no more than 100% after one month, whereas a solution with no addenda was bleach-inactive in considerably less than one week.

EXAMPLE 2

The above experiment was repeated with the pH, however, adjusted to 6.0 with sodium hydroxide solution or dilute sulphuric acid as appropriate, using separate samples of 'HEPA', 'DTPA', catechol disulphonate ('TIRON'™) and a polyphosphate ('QUADRAFOS'™), and also a control sample with no sequestering agent present.

Figure 2:
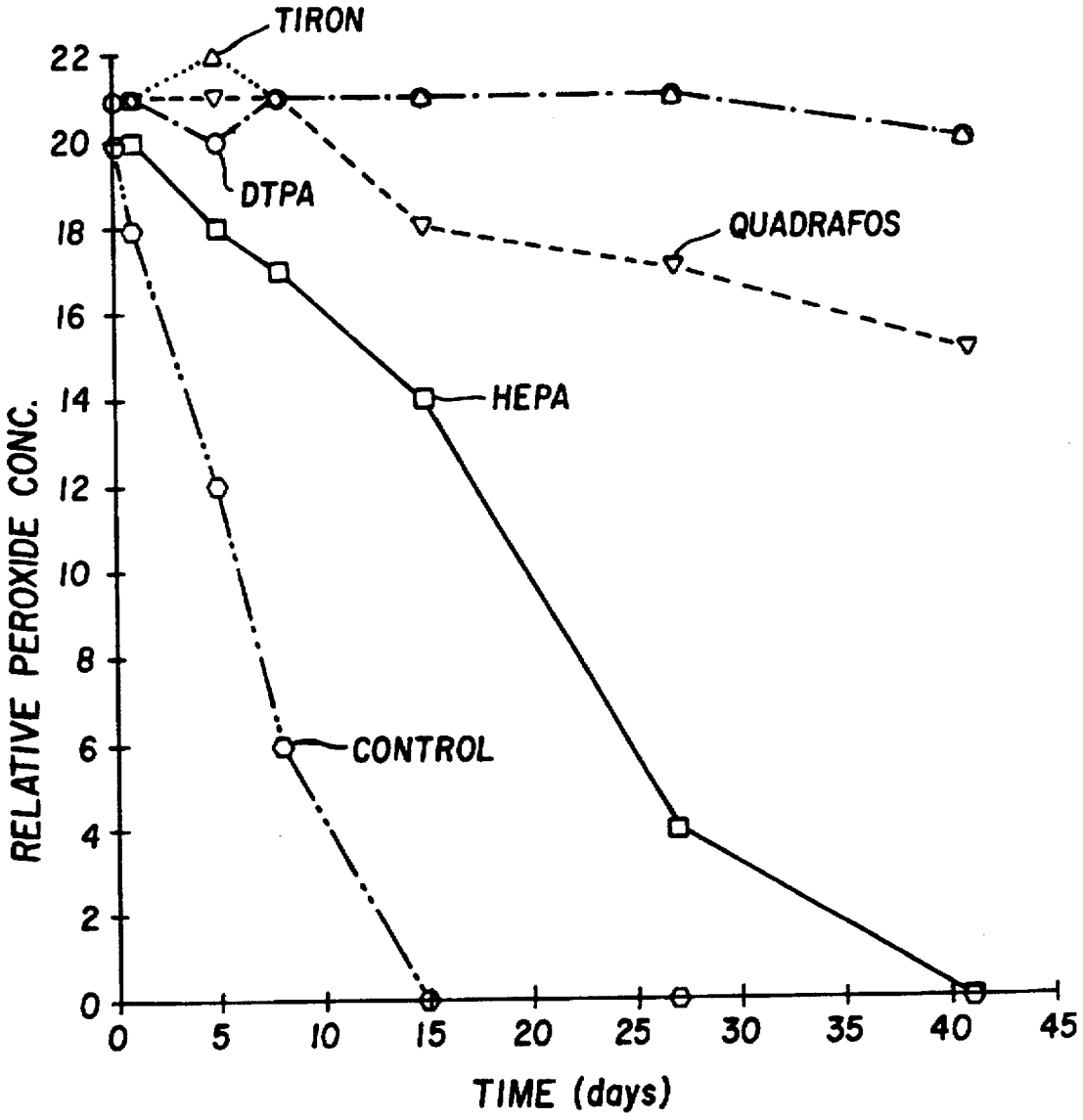
FIG. 2 is a graph of relative peroxide concentration versus time (days) showing the effect of sequestering agents on bleach stability at a pH of 6.0.

The results, which are shown graphically in FIG. 2, show that each sequestering agent tested had a substantial peroxide stabilising effect when compared with the control, with 'DTPA' and 'TIRON'™ having negligible loss in effect even after 6 weeks, 'QUADRAFOS'™ retaining a good level for this time and 'HEPA' only falling to nil peroxide concentration after this 6 week period compared with 2 weeks for the control.

The bleaching ability of the stored bleach was confirmed as described in Example 1.

I claim:

1. A photographic bleach solution, comprising hydrogen peroxide, or a compound capable of releasing hydrogen peroxide, and two or more sequestering agents capable of complexing a transition metal ion, wherein said bleach solution has a pH in the alkaline range, wherein each sequestering agent is selected from the group consisting of a polyalkylcarboxylic, polyalkylphosphonic or polyalkylsulphonic acid of formula (I)

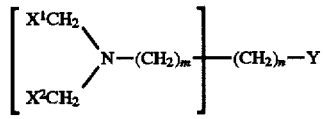

(I)

wherein $X^1$ and $X^2$ may be the same or different and each is a hydrogen atom, a straight or branched chain alkyl group having 1 to 6 carbon atoms, a hydroxyl, carboxyl, sulphonyl or phosphonyl group or the group Z, wherein group Z is

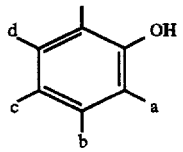

wherein a, b, c and d are the same or different and each is a hydrogen atom, a straight or branched chain alkyl group having 1 to 6 carbon atoms, a hydroxyl, carboxyl, sulphonyl or phosphonyl group or one or both of $X^1$ and $X^2$ may be repeat units of group A or group B, wherein group A is

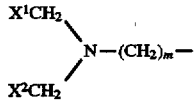

and group B is

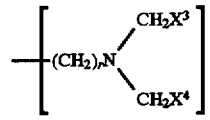

Y is the same as a, b, c, and d or is the group Z or the group B, wherein $X^3$ and $X^4$ are the same or different and the same as $X^1$ and $X^2$, wherein the sum of m, n and r is an integer from 1 to 10, and wherein one or both of the hydrogen atoms in each of the $(CH_2)_m$, $(CH_2)_n$ or $(CH_2)_r$ groups may be replaced by a straight or branched chain alkyl group having 1 to 6 carbon atoms, with the proviso that at least one of $X^1$, $X^2$, $X^3$ and $X^4$ comprises a sulphonyl or phosphonyl group or a salt thereof, or at least three of $X^1$, $X^2$, $X^3$ and $X^4$ comprise a carboxylic group or a salt thereof;

a diphosphonic acid of formula (II)

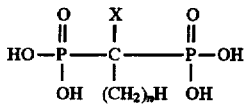

(II)

wherein X is a hydrogen atom, a halogen atom or a hydroxyl group and n is an integer from 0 to 12;

a polyhydroxyphenyl compound of formula (III)

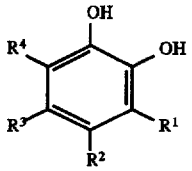

(III)

wherein $R^1$, $R^2$, $R^3$, and $R^4$ are the same or different and each is a hydrogen atom, a straight or branched chain alkyl group having 1 to 6 carbon atoms, a hydroxyl group, a sulphonyl group or a carboxyl group; and a polyphosphate of formula (IV)

$$HO(P(O)(OH)O—)_nH \quad (IV)$$

wherein n is from 4 to 12 or an alkali metal salt thereof.

2. A bleach solution as claimed in claim 1, additionally comprising a transition metal ion selected from the group consisting of copper, iron and manganese.

3. A bleach solution as claimed in claim 1, wherein said bleach solution further comprises halide ions.

4. A bleach solution as claimed in claim 1, comprising a compound of formula (I), wherein at least one of $X^1$, $X^2$, $X^3$ and $X^4$ is a carboxylic acid group.

5. A bleach solution as claimed in claim 1, comprising in combination a polyalkylcarboxylic acid of formula (I), or a salt thereof, with a diphosphonic acid of formula (II) or a polyphosphate of formula (IV) or an alkali metal salt thereof.

6. A bleach solution as claimed in claim 1, wherein the polyalkylcarboxylic acid of formula (I) is diethylenetriaminepentaacetic acid.

7. A bleach solution as claimed in claim 1, wherein the compound of formula (II) is 1-hydroxyethylidene-1,1-diphosphonic acid.

8. A bleach solution as claimed in claim 1, wherein the compound of formula (III) is dihydroxyphenyl sulphonate.

9. A bleach solution as claimed in claim 1 wherein in the compound of formula (IV) n is from 4 to 8.

10. A bleach solution as claimed in claim 1, wherein the sequestrants are diethylenetriaminepentaacetic acid and 1-hydroxyethylidene-1,1-diphosphonic acid.

11. A bleach solution as claimed in claim 3 wherein the ratio of any two sequestering agents is in the range of from 1:1 to 1:10 by weight wherein either sequestering agent may be present in the greater amount.

12. A bleach solution as claimed in claim 3, wherein each sequestering agent in the bleach solution is present in an amount of from about 0.005 to 5% by weight of bleach solution.

13. A bleach solution as claimed in claim 12, wherein each sequestering agent is present in an amount of from 0.04% to 0.1% by weight of bleach solution.

14. A bleach solution as claimed in claim 1, wherein 30% hydrogen peroxide is used in an amount of from 20 to 100 ml per liter of solution.

15. A bleach solution as claimed in claim 14, wherein 30% hydrogen peroxide is used in an amount of 50 ml per liter of bleach solution.

16. A method of processing a color material, comprising:

providing an exposed and developed color silver halide photographic material, and contacting said developed color photographic material with a bleach solution comprising hydrogen peroxide, or a compound capable of releasing hydrogen peroxide, and two or more sequestering agents capable of forming a complex with a transition metal ion, wherein said bleach solution has a pH in the alkaline range wherein each sequestering agent is selected from the group consisting of a polyalkylcarboxylic, polyalkylphosphonic or polyalkylsulphonic acid of formula (I)

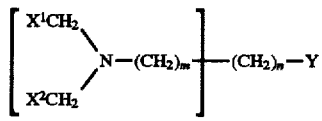

(I)

wherein $X^1$ and $X^2$ may be the same or different and each is a hydrogen atom, a straight or branched chain alkyl group having 1 to 6 carbon atoms, a hydroxyl, carboxyl, sulphonyl or phosphonyl group or the group Z, wherein group Z is

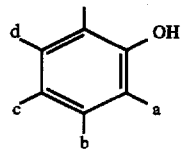

wherein a, b, c and d are the same or different and each is a hydrogen atom, a straight or branched chain alkyl group having 1 to 6 carbon atoms, a hydroxyl, carboxyl, sulphonyl or phosphonyl group or one or both of $X^1$ and $X^2$ may be repeat units of group A or group B, wherein group A is

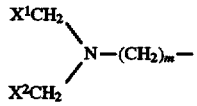

and group B is

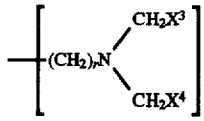

Y is the same as a, b, c, and d or is the group Z or the group B, wherein $X^3$ and $X^4$ are the same or different and are the same as $X^1$ and $X^2$ wherein the sum of m, n and r is an integer from 1 to 10 and wherein one or both of the hydrogen atoms in each of the $(CH_2)_m$, $(CH_2)_n$ or $(CH_2)_r$ groups may be replaced by a straight or branched chain alkyl group having 1 to 6 carbon atoms, with the proviso that at least one of $X^1$, $X^2$, $X^3$ and $X^4$ comprises a sulphonyl or phosphonyl group or a salt thereof, or at least three of $X^1$, $X^2$, $X^3$ and $X^4$ comprise a carboxylic group or a salt thereof;

a diphosphonic acid of formula (II)

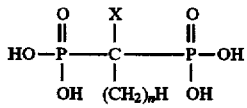

(II)

wherein X is a hydrogen atom, a halogen atom or a hydroxyl group and n is an integer from 0 to 12;

a polyhydroxyphenyl compound of formula (III)
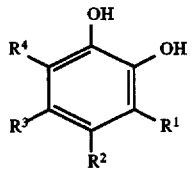
(III)
wherein $R^1$, $R^2$, $R^3$, and $R^4$ are the same or different and each is a hydrogen atom, a straight or branched chain alkyl group having 1 to 6 carbon atoms, a hydroxyl group, a sulphonyl group or a carboxy group; and
a polyphosphate of formula (IV)
$$HO(P(O)(OH)O—)_nH \quad (IV)$$
wherein n is from 4 to 12
or an alkali metal salt thereof.
* * * * *